US006457264B2

(12) United States Patent
Fusco et al.

(10) Patent No.: US 6,457,264 B2
(45) Date of Patent: Oct. 1, 2002

(54) SPIKE FOR AN ATHLETIC SHOE

(75) Inventors: Ciro Fusco, Portland, OR (US); Simon M. Luthi, Lake Oswego, OR (US); Dayle Prowse, Portland, OR (US)

(73) Assignee: adidas International B.V. (NL)

( * ) Notice: Subject to any disclaimer, the term of this patent is extended or adjusted under 35 U.S.C. 154(b) by 0 days.

(21) Appl. No.: 09/783,198

(22) Filed: Feb. 14, 2001

Related U.S. Application Data

(63) Continuation of application No. 09/245,178, filed on Feb. 5, 1999, now abandoned.

(51) Int. Cl.[7] ..... A43B 5/00; A43B 15/00

(52) U.S. Cl. ..... 36/67 D; 36/134; D2/906; D2/908

(58) Field of Search ..... 36/134, 67 R, 36/67 D, 59 C; D2/906, 908, 953, 960

(56) References Cited

U.S. PATENT DOCUMENTS

| | | | | |
|---|---|---|---|---|
| D74,252 | S | | 1/1928 | Blair |
| 1,847,217 | A | | 3/1932 | Klein |
| 2,394,454 | A | | 2/1946 | Kappeler |
| 3,526,976 | A | | 9/1970 | Jacobs |
| 3,656,245 | A | | 4/1972 | Wilson |
| 3,747,237 | A | | 7/1973 | Wilowski |
| D238,524 | S | | 1/1976 | Senter |
| 4,212,120 | A | | 7/1980 | Bowerman et al. |
| 4,375,728 | A | | 3/1983 | Dassler |
| 4,564,966 | A | * | 1/1986 | Chen |
| 5,259,129 | A | * | 11/1993 | Deacon et al. |
| 5,293,701 | A | | 3/1994 | Sullivan |
| D366,135 | S | | 1/1996 | Henderson et al. |
| 5,782,017 | A | | 7/1998 | Ortscheid |

FOREIGN PATENT DOCUMENTS

| | | |
|---|---|---|
| DE | 3134817 | 3/1983 |

* cited by examiner

*Primary Examiner*—M. D. Patterson
(74) *Attorney, Agent, or Firm*—Testa, Hurwitz & Thibeault, LLP

(57) ABSTRACT

A spike for an athletic shoe having a ground engaging portion which is generally z-shaped in cross-section A spike according to the invention includes a first elongate portion having second and third elongate portions extending angularly therefrom. The second and third portions are parallel in one embodiment. In other embodiment, the respective angles of the second and third portions with respect to the central portion may vary slightly. The invention is also embodied in a shoe having one or more spikes as described above and arranged in a predetermined pattern.

14 Claims, 2 Drawing Sheets

SPIKE FOR AN ATHLETIC SHOE

CROSS-REFERENCE TO RELATED APPLICATION

This application incorporates by reference, and claims priority to, and the benefit of, U.S. patent application Ser. No. 09/245,178, filed Feb. 5, 1999, now abandoned of which this is a continuation.

BACKGROUND OF THE INVENTION

The present invention relates to athletic shoes, and in particular to spikes for athletic shoes that provide good traction in the forward direction, resist twisting, and that minimize the number of spikes which must be fitted to a shoe.

Athletic shoes for various sports, including track events, are fitted with spikes to provide traction for accelerating and stopping, and to resist twisting of the shoe. Athletic shoe spikes are provided in various shapes and arrangements depending on the requirements of the particular sport. Track shoes are typically fitted with a large number of tapered spikes which may be conical or wedge-shaped such as shown in U.S. Pat. No. 4,546,559 to Dassler, or in U.S. Pat. No. 4,569,142 to Koskela. As exemplified by those references, prior art shoes typically include a relatively large number of spikes due to inherent limitations in the traction provided by the individual spikes. However, minimizing the weight of an athletic shoe is always of primary importance. This is true of track and field shoes in particular. Weight could be removed from track and field shoes if an improved spike were available which provided the required traction with fewer spikes. A need therefore remains for an improved spike for athletic shoes which provides improved traction and stability, and which provides for an overall weight savings.

SUMMARY OF THE INVENTION

It is therefore an object of the invention to provide a spike for use in athletic shoes which provides improved traction.

It is a second object of the invention to provide a spike which reduces the overall number of spikes required to provide adequate traction and stability in athletic shoes.

It is another object of the invention to provide a spike which is omnidirectional.

It is another object of the invention to provide a spike which is readily and economically manufactured.

It is yet another object of the invention to provide a spike which can be affixed to an athletic shoe sole by conventional means, or which in the alternative can be formed integrally with a shoe sole.

The present invention is embodied in a spike for use with athletic shoes which includes a distal portion with a generally z-shaped cross-sectional shape. The z-shaped distal portion includes a first, central elongate portion with second and third elongate portions extending angularly therefrom. In the preferred embodiment, the second and third portions are parallel, or nearly so. However, the invention is not limited to a spike in which the second and third portions extend from the central portion at any particular angle, or at equal angles. A spike according to the invention may be integrally molded with the sole, or may be a separate structure that is attached to the sole by an adhesive or by a threaded base portion. The invention is not limited to a spike formed of any particular material, although a metal-ceramic or a polymeric material is preferred.

These and other objects and features of the invention will be described with reference to preferred embodiments of the invention, and with reference to the accompanying figures.

DETAILED DESCRIPTION OF THE DRAWINGS

DETAILED DESCRIPTION OF THE PREFERRED EMBODIMENT

Figure 1:
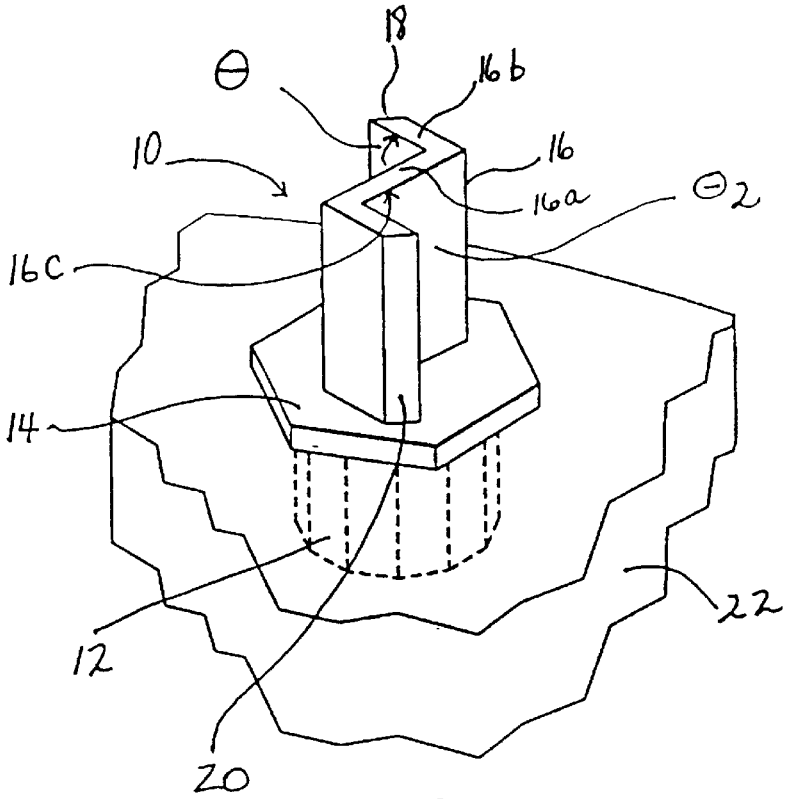
FIG. 1 is a perspective view of a spike according to the invention, showing in phantom a base portion embedded in a shoe sole.
Figure 3:
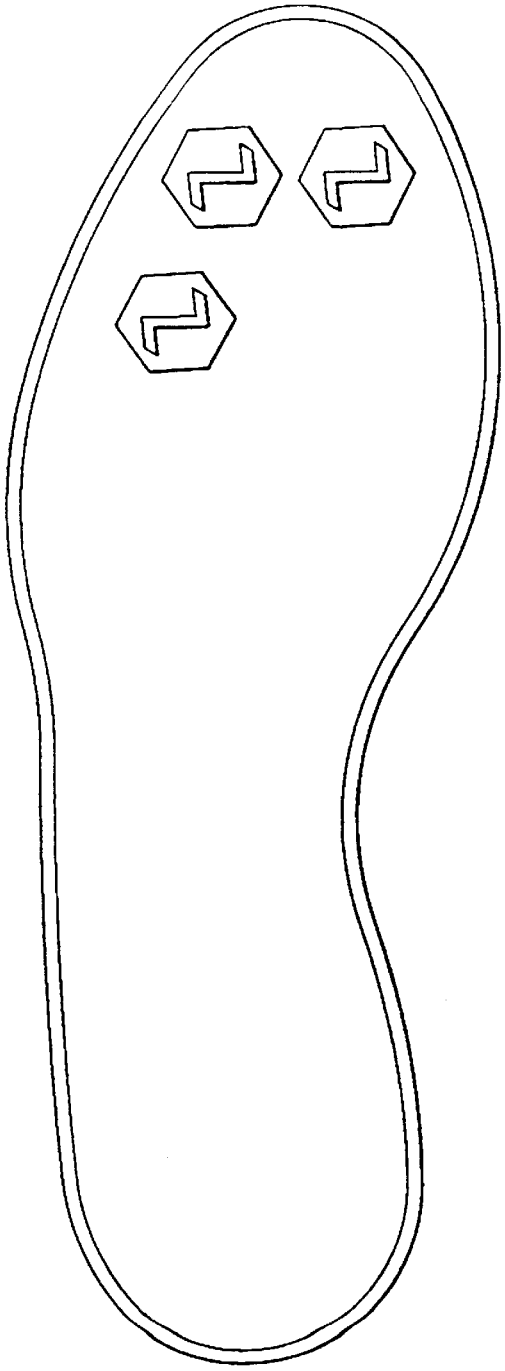
FIG. 3 is a bottom plan view of a shoe sole having z-shaped spikes beneath the toes and fifth metatarsal, and the heel according to a second preferred embodiment of the invention.
Figure 1:
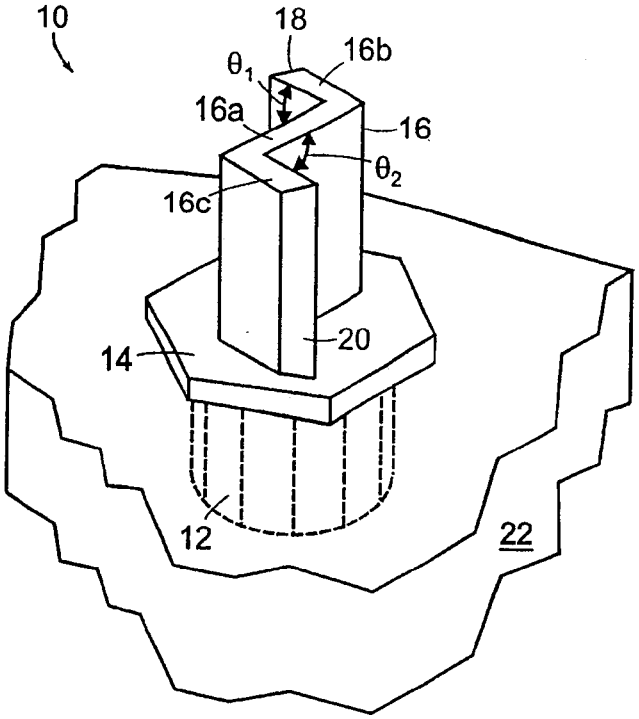
Figure 4:
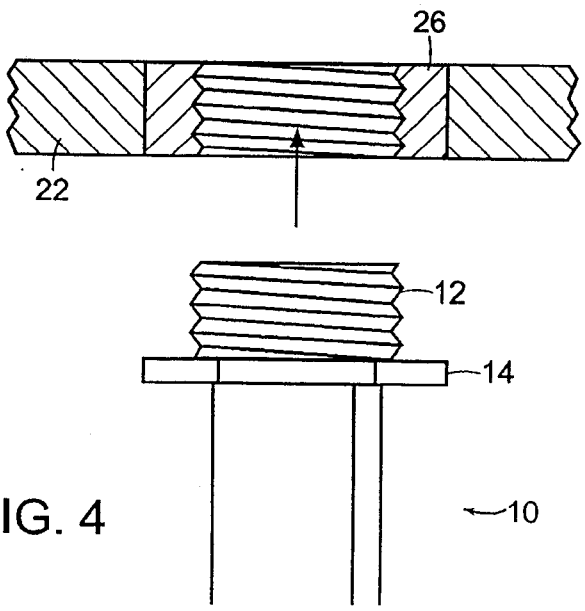
Figure 2:
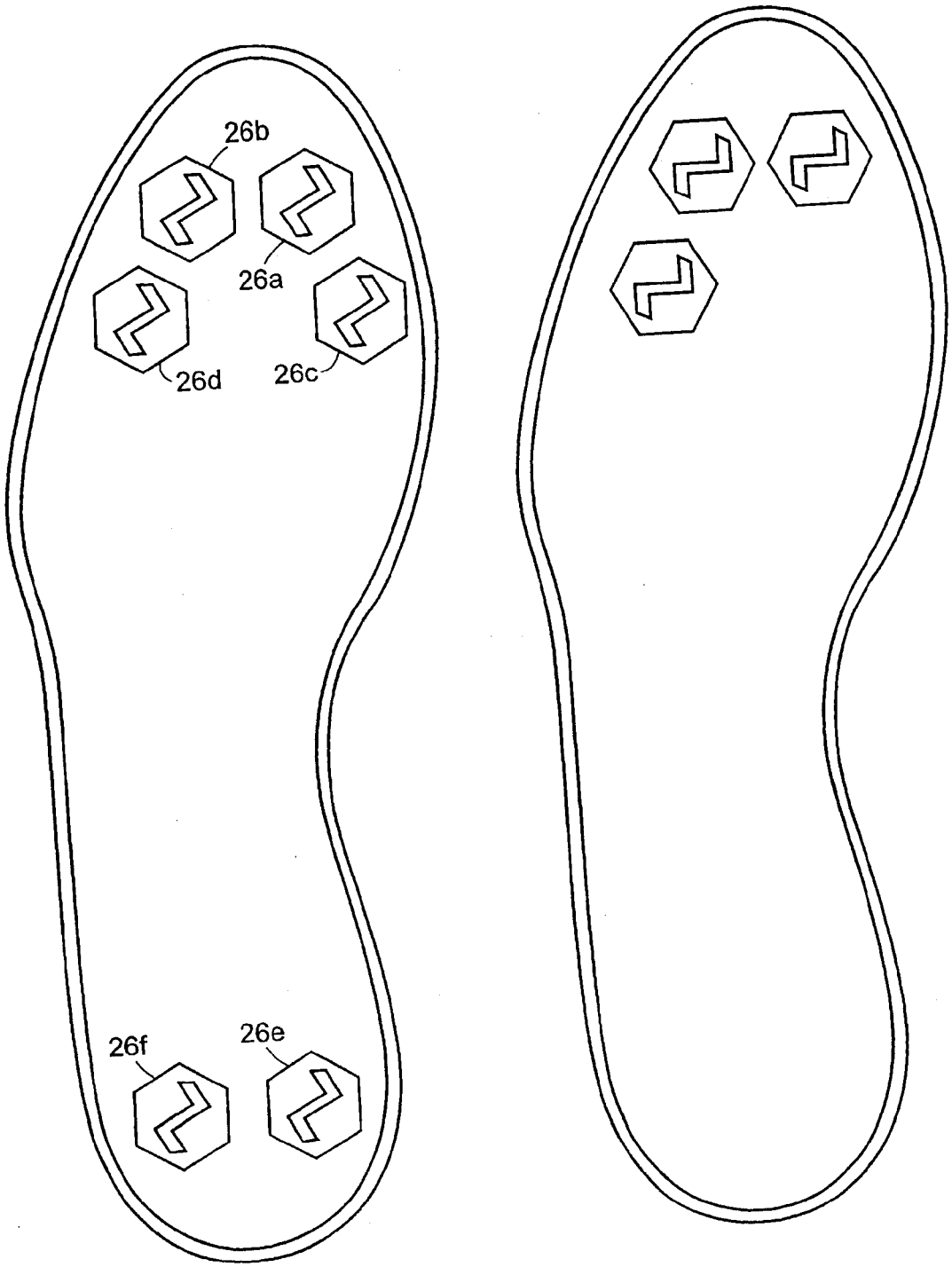

Turning now to FIG. 1, a spike according to a preferred embodiment of the invention is shown generally at 10. Spike 10 includes a base portion 12, a flange 14, and a distal, ground-engaging spike portion 16. Spike portion 16 is of an angular design generally resembling the letter "z". Stated in a slightly different way, spike portion 16 includes a central elongated portion 16*a*, and elongated portions 16*b* and 16*c* which extend at an angle from opposite ends of central portion 16*a*. In the preferred embodiment, portions 16*b* and 16*c* are parallel, and extend from central portion 16*a* at included angles $\theta_1$ and $\theta_2$. $\theta_1$ and $\theta_2$ are preferably between 75° and 120°, and most preferably between about 80 and 100°, although the invention is not limited to any particular value of $\theta_1$ or $\theta_2$. In alternate embodiments of the invention, portions 16*b* and 16*c* are canted in the same general direction relative to central portion 16*a* but are not exactly parallel, i.e. $\theta_1$ and $\theta_2$ are not equal. In another aspect of the invention, central portion 16*a* is oriented in various directions, i.e. parallel (not shown), perpendicular (FIG. 3), or at an intermediate angle (FIG. 1) with respect to a longitudinal axis of the shoe. Spike 12 is preferably about 5 mm in height, 4–5 mm in overall length, and about 3.75 mm in overall width. While these overall dimensions are preferred, the invention is not limited thereto. Individual athletes could find that slightly different dimensions are preferable for particular events. A spike according to the invention is operable in any rotational position, and need not be oriented in any particular rotational direction. Accordingly, the multiple spikes on a single shoe need not be rotationally aligned.

Figure 4:
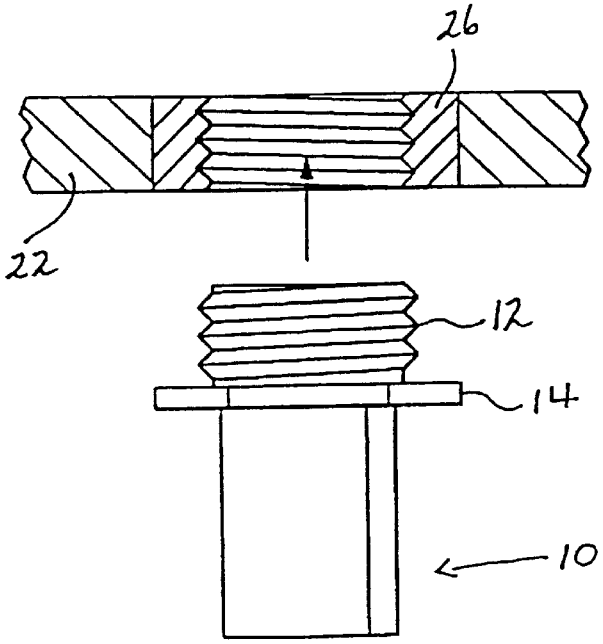
FIG. 4 is a side elevational view of a spike according to the invention and which includes a threaded base for engagement with a threaded insert in the shoe sole.

In the preferred embodiment described above, each spike includes a base 12, a spike portion 16, and a flange 14. In that embodiment, spike 10 is attached to the shoe by embedding base 12 in a sole 22. Base 12 is preferably threaded into a hole in sole 22, or into a threaded insert 26 which is mounted in sole 22 (FIG. 4). In the embodiment shown in FIG. 4, flange 14 abuts sole 22. In other embodiments, flange 14 may be fully or partially embedded in sole 22. In those embodiments, flange 14 may be hexagonal or otherwise shaped so that when embedded in sole 22, it will resist rotational forces exerted on spike 10.

In other embodiments, a molded, unitary sole of a shoe includes one or more integrally molded spikes protruding from the sole and configured in one of the configurations of spike portion 16 as described above.

In each of the foregoing embodiments, the spikes are preferably formed from an aluminum-ceramic mixed material. In the alternative, the spikes could be made of polymeric materials or metals, or any other material having suitable strength and forming properties. The invention is not limited to any particular material of construction, ceramic, polymeric or otherwise, or to a spike formed by molding or any other particular manufacturing method.

In another aspect of the invention, the number and placement of spikes on the sole of the shoe can vary for use in different events. In each instance, the number and placement of spikes is chosen to best accommodate the running style for a particular event, e.g. whether the runner's foot lands on the heel or on the metatarsals, and whether the track is curved or straight. For example, in one preferred embodiment two spikes are mounted beneath toes (26*a,* 26*b*), two beneath the metatarsal area of the foot (26*c,* 26*d*), and two spikes (26*e*–26*f*) are mounted beneath the heel. For use in a 100 meter sprint, one preferred embodiment utilizes two spikes under the toes and one spike under either the first or fifth metatarsal head. (As used herein, the first metatarsal is located nearest the medial side of the foot.) In embodiments having three spikes, the third spike may be located under the first metatarsal on the left shoe, and under the fifth metatarsal on the right shoe. Conversely, the third spike may be located under either the fifth metatarsal on the left shoe, and under the first metatarsal on the right shoe. For intermediate length events, e.g. 200/400/800 meters, and for a 4×100 relay in which the runners run on curved track sections, four spikes are preferred, two under the toe region and one each under the first and fifth metatarsal heads.

Having described the invention with reference to the foregoing illustrative embodiments, those skilled in the art will recognize that numerous modifications in detail and arrangement are possible without departing from the scope and spirit of the following claims.

What is claimed is:

1. A shoe including a longitudinal axis, the shoe comprising:

an upper;

a ground-engaging surface of a sole; and at least one spike having a distal portion protruding from the ground-engaging surface of the sole, the distal portion comprising first, second, and third elongate portions and having a solid, contiguous cross-sectional shape, wherein the second and third elongate portions extend from opposite ends of the first elongate portion in generally opposite directions, wherein an included angle between the second elongate portion and the first elongate portion is between about 75° to about 170°, and at least one of the elongate portions is substantially parallel to the longitudinal axis of the shoe.

2. A shoe according to claim 1, wherein an included angle between the second elongate portion and the first elongate portion is between about 75° and about 120°.

3. A shoe according to claim 1, wherein an included angle between the second elongate portion and the first elongate portion is between about 80° and about 100°.

4. A shoe according to claim 1, wherein an included angle between the third elongate portion and the first elongate portion is between about 75° and about 170°.

5. A shoe according to claim 1, wherein an included angle between the third elongate portion and the first elongate portion is between about 75° and about 120°.

6. A shoe according to claim 1, wherein an included angle between the third elongate portion and the first elongate portion is between about 80° and about 100°.

7. A shoe according to claim 1, wherein the second elongate portion and the third elongate portion are generally parallel.

8. A shoe according to claim 1, wherein the spike further comprises a mounting base engaged with the sole of the shoe.

9. A shoe according to claim 8, wherein the spike further comprises a flange connected to the mounting base.

10. A shoe according to claim 1, wherein the shoe includes a toe portion and a metatarsal portion and wherein the at least one spike underlies the toe portion of the shoe.

11. A shoe according to claim 1, wherein the shoe includes a toe portion and a metatarsal portion and wherein the at least one spike underlies the metatarsal portion of the shoe.

12. A shoe according to claim 1, wherein the shoe includes a toe portion, a metatarsal portion, and at least three spikes, wherein at least two spikes underlie the toe portion of the shoe and at least one spike underlies a metatarsal portion of the shoe.

13. A shoe according to claim 1, wherein the shoe further comprises:

a forefoot region, a heel region; and a plurality of spikes, wherein at least one spike is disposed in the forefoot portion and at least one spike is disposed in the heel portion.

14. A shoe according to claim 1, wherein the spike comprises a material selected from the group consisting of a metal, a ceramic, a polymer, and combinations thereof.

* * * * *

UNITED STATES PATENT AND TRADEMARK OFFICE

CERTIFICATE OF CORRECTION

PATENT NO. : 6,457,264 B2
DATED : October 1, 2002
INVENTOR(S) : Ciro Fusco et al.

It is certified that error appears in the above-identified patent and that said Letters Patent is hereby corrected as shown below:

The title page should be deleted and substitute therefore the attached title page.

Figure 2:
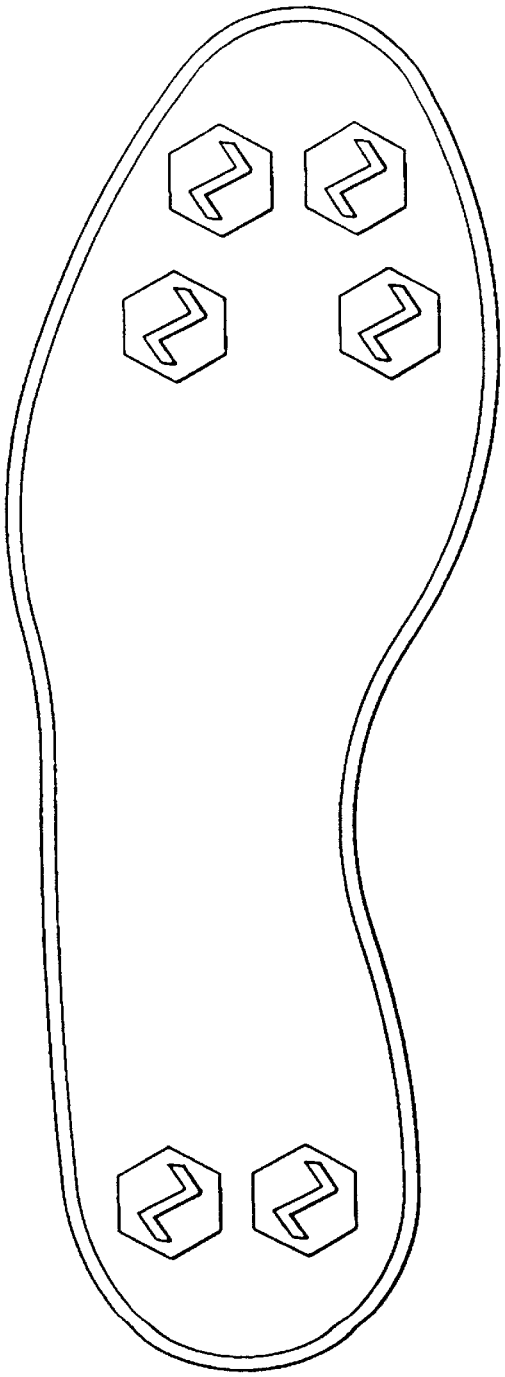
FIG. 2 is a bottom plan view of a shoe sole having z-shaped spikes beneath the toes, first and fifth metatarsals, and the heel according to a preferred embodiment of the invention.

Delete the drawing sheets 1-2 and substitute therefore the drawing sheets 1-2, consisting of Figs. 1, 2 and 4 as shown on the attached pages.

Title page,
Item [57], ABSTRACT,
Line 2, add a period after "cross-section".

Column 4,
Line 45, replace "the forefoot portion" with -- the forefoot region --.
Line 46, replace "the heel portion" with -- the heel region --.

Signed and Sealed this

Thirtieth Day of December, 2003

JAMES E. ROGAN
*Director of the United States Patent and Trademark Office*

(12) United States Patent
Fusco et al.

(10) Patent No.: US 6,457,264 B2
(45) Date of Patent: Oct. 1, 2002

(54) SPIKE FOR AN ATHLETIC SHOE

(75) Inventors: Ciro Fusco, Portland, OR (US); Simon M. Luthi, Lake Oswego, OR (US); Dayle Prowse, Portland, OR (US)

(73) Assignee: adidas International B.V. (NL)

( * ) Notice: Subject to any disclaimer, the term of this patent is extended or adjusted under 35 U.S.C. 154(b) by 0 days.

(21) Appl. No.: 09/783,198

(22) Filed: Feb. 14, 2001

Related U.S. Application Data

(63) Continuation of application No. 09/245,178, filed on Feb. 5, 1999, now abandoned.

(51) Int. Cl.[7] ..... A43B 5/00; A43B 15/00

(52) U.S. Cl. ..... 36/67 D; 36/134; D2/906; D2/908

(58) Field of Search ..... 36/134, 67 R, 36/67 D, 59 C; D2/906, 908, 953, 960

(56) References Cited

U.S. PATENT DOCUMENTS

| | | | | |
|---|---|---|---|---|
| D74,252 | S | | 1/1928 | Blair |
| 1,847,217 | A | | 3/1932 | Klein |
| 2,394,454 | A | | 2/1946 | Kappeler |
| 3,526,976 | A | | 9/1970 | Jacobs |
| 3,656,245 | A | | 4/1972 | Wilson |
| 3,747,237 | A | | 7/1973 | Wilowski |
| D238,524 | S | | 1/1976 | Senter |
| 4,212,120 | A | | 7/1980 | Bowerman et al. |
| 4,375,728 | A | | 3/1983 | Dassler |
| 4,564,966 | A | * | 1/1986 | Chen |
| 5,259,129 | A | * | 11/1993 | Deacon et al. |
| 5,293,701 | A | | 3/1994 | Sullivan |
| D366,135 | S | | 1/1996 | Henderson et al. |
| 5,782,017 | A | | 7/1998 | Ortscheid |

FOREIGN PATENT DOCUMENTS

| | | |
|---|---|---|
| DE | 3134817 | 3/1983 |

* cited by examiner

*Primary Examiner*—M. D. Patterson
(74) *Attorney, Agent, or Firm*—Testa, Hurwitz & Thibeault, LLP

(57) ABSTRACT

A spike for an athletic shoe having a ground engaging portion which is generally z-shaped in cross-section A spike according to the invention includes a first elongate portion having second and third elongate portions extending angularly therefrom. The second and third portions are parallel in one embodiment. In other embodiment, the respective angles of the second and third portions with respect to the central portion may vary slightly. The invention is also embodied in a shoe having one or more spikes as described above and arranged in a predetermined pattern.

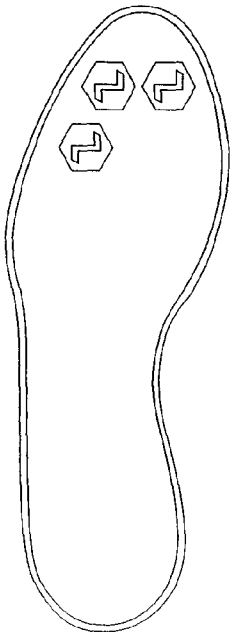

14 Claims, 2 Drawing Sheets